US008191494B2

(12) United States Patent
Tosch, Jr. et al.

(10) Patent No.: US 8,191,494 B2
(45) Date of Patent: Jun. 5, 2012

(54) UNDERWATER DIVE PLANE

(76) Inventors: Paul Richard Tosch, Jr., Auburn, WA (US); Mark Oliver Thomas Queen, Tacoma, WA (US)

( * ) Notice: Subject to any disclaimer, the term of this patent is extended or adjusted under 35 U.S.C. 154(b) by 97 days.

(21) Appl. No.: 12/725,621

(22) Filed: Mar. 17, 2010

(65) Prior Publication Data

US 2010/0236467 A1 Sep. 23, 2010

Related U.S. Application Data

(60) Provisional application No. 61/161,136, filed on Mar. 18, 2010.

(51) Int. Cl.
*B63C 11/46* (2006.01)

(52) U.S. Cl. ..... 114/315; 114/245

(58) Field of Classification Search ..... 114/242, 114/244, 245, 246, 253, 315
See application file for complete search history.

(56) References Cited

U.S. PATENT DOCUMENTS

| | | | | |
|---|---|---|---|---|
| 3,261,318 | A * | 7/1966 | Jones et al. | 114/245 |
| 4,207,829 | A * | 6/1980 | Meister et al. | 114/245 |
| 4,624,207 | A | 11/1986 | King | |
| 5,178,090 | A * | 1/1993 | Carter | 114/315 |
| 6,561,116 | B2 | 5/2003 | Linjawi | |
| 6,575,114 | B2 | 6/2003 | Sandler et al. | |

* cited by examiner

*Primary Examiner* — Lars A Olson

(57) ABSTRACT

An underwater dive plane includes a central rotating hub, rotating wing holders on either side of the central rotating hub, and wings attached to the wing holders. The attachment is accomplished by a threaded bolt inserted through the center of the central rotating hub and through the center of the wing holders in a way that permits the wing holders to rotate around the threaded bolt. A rope threaded through a hole in the central rotating hub leads to a watercraft and allows towing a person holding onto the dive plane. The rotating wings allow the diver to control the angle and direction of the dive.

14 Claims, 3 Drawing Sheets

UNDERWATER DIVE PLANE

CROSS-REFERENCE TO RELATED APPLICATIONS

This application claims the benefit of U.S. Provisional application No. 61/161,136 filed Mar. 18, 2010.

BACKGROUND OF THE INVENTION

The present invention generally relates to underwater dive planes and, more particularly, to a towable, manually operated dual axis dive plane for recreational purposes that may allow the diver to manipulate the pitch and roll angle of the dive.

Considerable effort is needed to free dive to various depths under water. Scuba divers and snorkelers often wish more rapid travel across the ground than dive fins provide alone. The ability to be towed behind a powered watercraft may provide the more rapid travel, however, most conventional dive planes only offer single axis controllability.

As can be seen, there is a need for a towable, manually operated dual axis dive plane allowing divers or snorkelers the ability to control both pitch and roll underwater at various speeds and depths according to the comfort level of each individual.

SUMMARY OF THE INVENTION

In one aspect of the present invention, a underwater dive plane comprises a central rotating hub having first and second sides and a center bore; a hole in the central rotating hub; first and second wing holders rotatably disposed against the first and second sides of the central rotating hub; first and second wings attached to the first and second wing holders.

In another aspect of the present invention, a underwater dive plane comprise a central rotating hub having first and second sides and a center bore; a hole in the central rotating hub; first and second wing holders rotatably disposed against the first and second sides of the central rotating hub; first and second wings attached to the first and second wing holders; a threaded bolt going through a center of the first and second wing holders, the rotating wing holders being adapted for rotating around the threaded bolt; and a locking nut for threading onto the threaded bolt to attach the wing holders onto the central rotating hub.

These and other features, aspects and advantages of the present invention will become better understood with reference to the following drawings, description and claims.

DETAILED DESCRIPTION OF THE INVENTION

Figure 1:
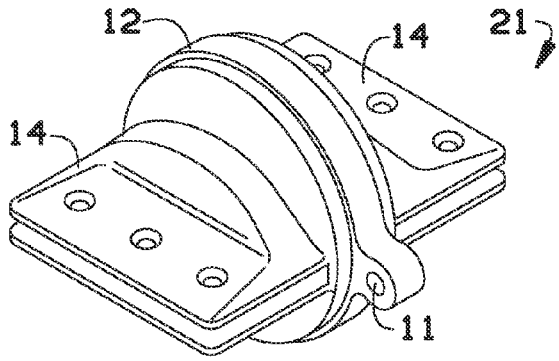
FIG. 1 is a perspective view of a central rotating hub of an underwater dive plane according to an embodiment of the present invention.
Figure 2:
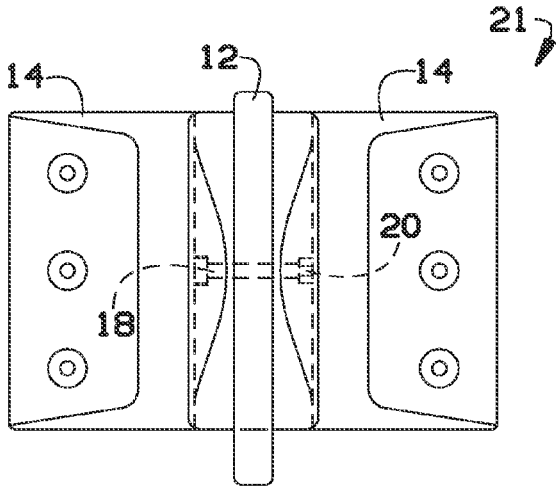
FIG. 2 is a top view of the hub of FIG. 1.
Figure 3:
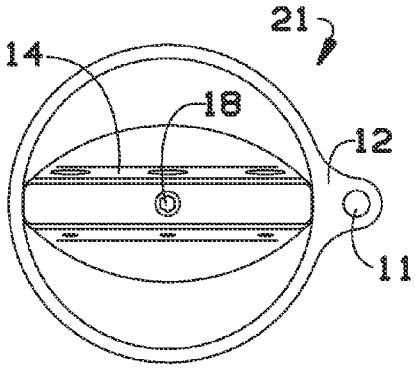
FIG. 3 is a side view of the hug of FIG. 1.
Figure 4:
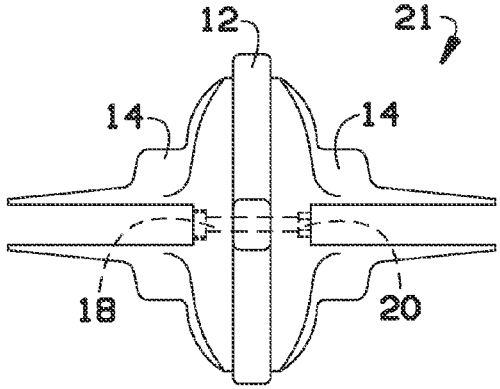
FIG. 4 is a front view of the hub of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a towable, two axes manually controlled underwater dive plane for the purpose of aquatic recreation. The assembly may include a central rotating hub and two detachable wings. The central hub, to which two wings attach, may be designed to rotate on its axis at an angle from about 45 degrees to about 80 degrees, up and down in opposite directions, to allow an operator to manipulate the angle of attack in order to descend or ascend in the water. Stops may be provided in the central hub to adjust the maximum angle depending on the skill level of the user. Each wing may rotate independently to allow roll control. The dive plane according to the present invention may be designed to be towed by a boat or watercraft by rope with a person in trail. An embodiment of the invention provides hand manipulate-able control surfaces, which, when towed through the water, may allow a diver or snorkeler the ability to dive with both pitch and roll control.

Referring to FIGS. 1 through 6, the dive plane 10 may include a central rotating hub 12 having a loop 11 to which a rope 26 used to tow the dive plane 10 may attach. Two rotating wing holders 14 may attach to each side of the central rotating hub 12. The wing holders 14 and the rotating hub 12 together may form a hub assembly 21.

Two wings 16 may attach to the wing holders 14 via a removable attachment means, such as screws 22, for example. The screws 22 may be removable to allow interchangeability of wings 16. For example, different shapes and sizes of wings may be used, depending on the needs and skill level of the user.

The central rotating hub 12 and wing holders 14 may attach by a threaded bolt 18 and a locking nut 20 going through a central axis of these parts. The wing holders 14 may be adapted to rotate around the threaded bolt. Each rotating wing holder 14 may provide attachment points to hold each wing 16. The leading edges of the wings 16 may travel perpendicular to the vector of the tow direction in order to provide two axis controllability. A person can manipulate both wings 16 in the same direction (up or down) to control ascent or descent rates. The wings 16, manipulated in opposite directions of each other, may cause the device to roll through the water like a cork screw. The rate of roll may be controllable by the relative angles of rotation of the wings 16.

Figures 5, 6:
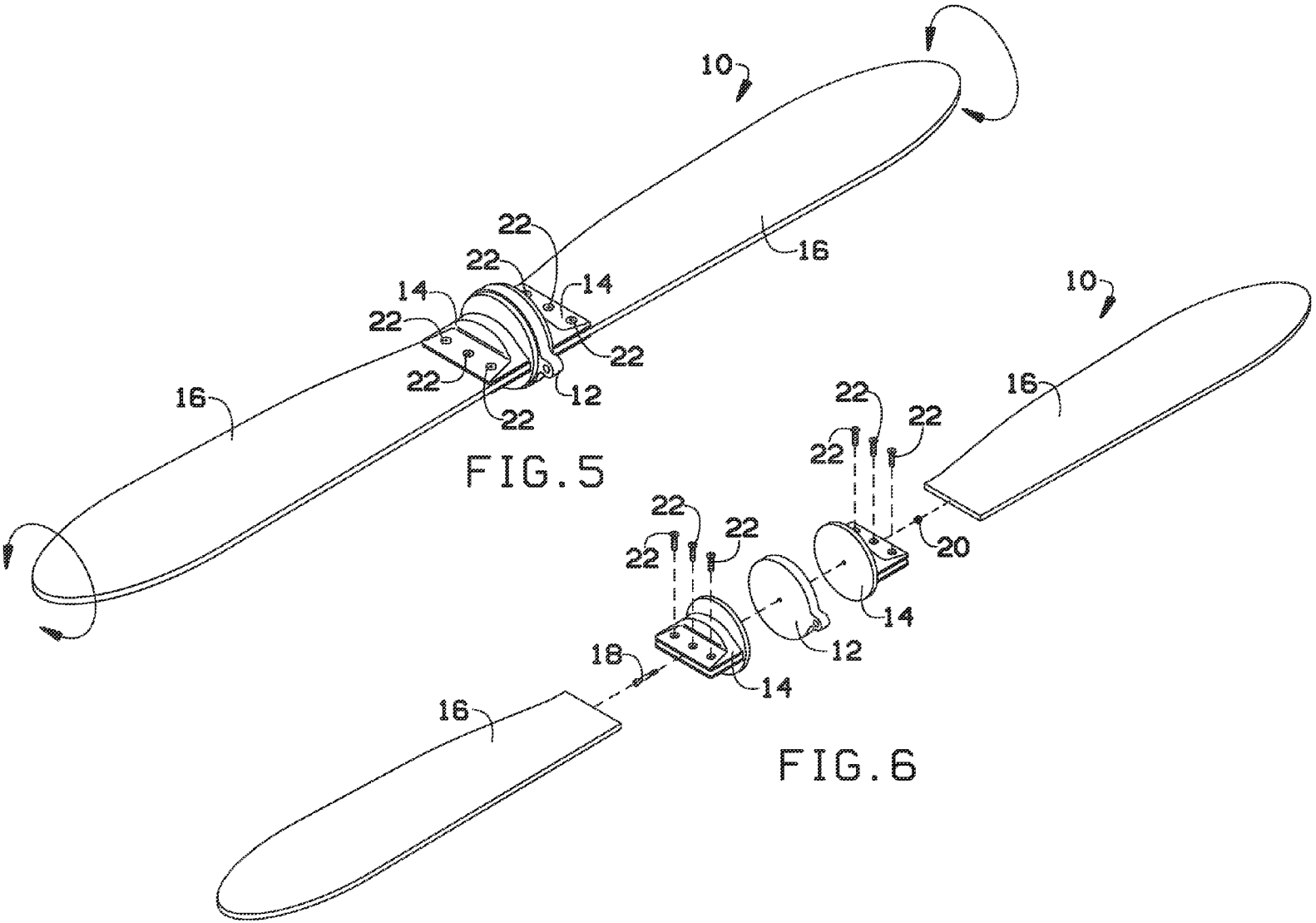
FIG. 5 is a perspective view of the underwater dive plane according to an embodiment of the present invention.
FIG. 6 is an exploded perspective view of the underwater dive plane of FIG. 5 according to an embodiment of the present invention.
Figure 7:
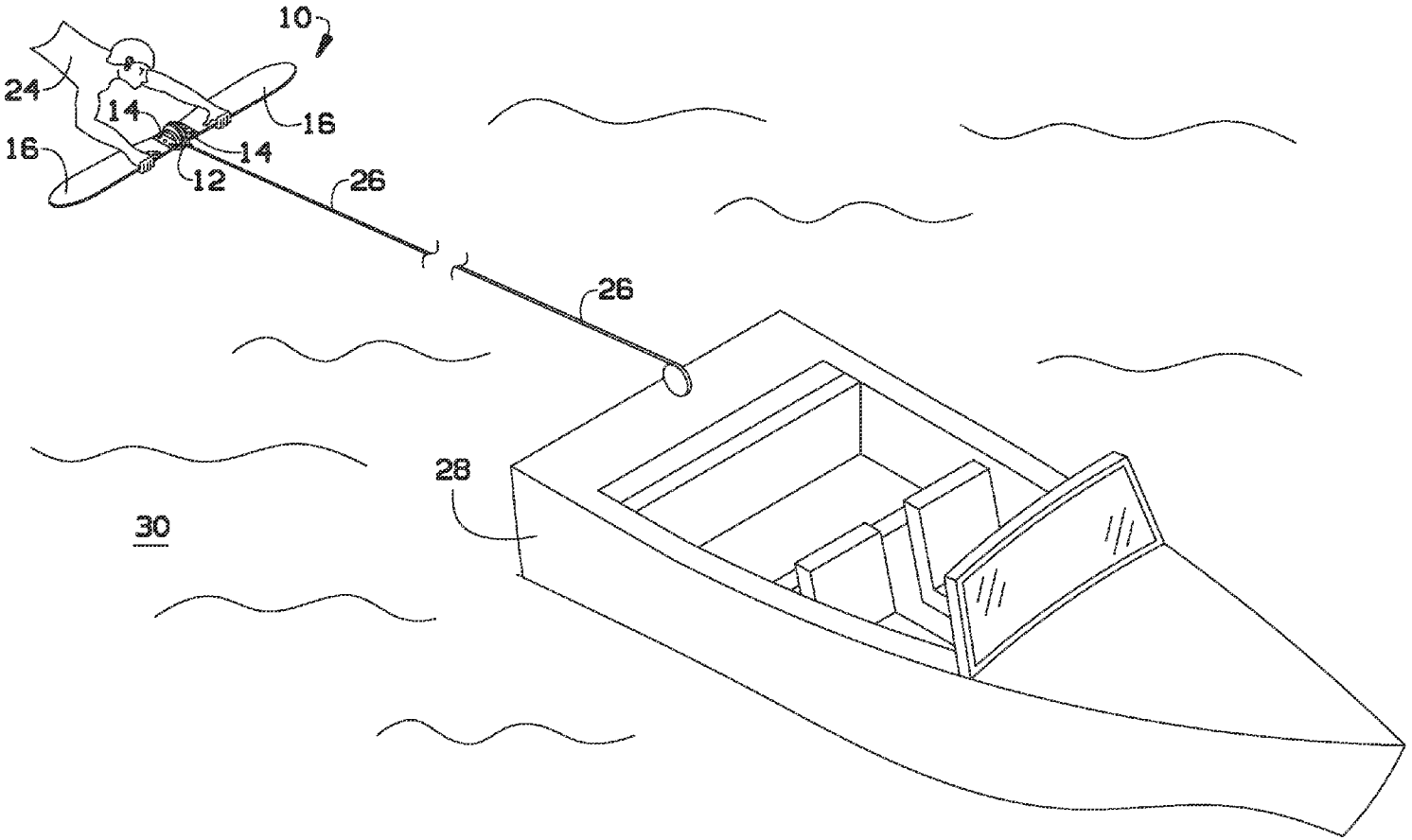
FIG. 7 is a perspective view of the underwater dive plane of FIG. 5 in use according to an embodiment of the present invention.

The central hub 12 may have computer designed components that require a computerized machining process, such as computer numerical control (CNC) machining. Each part of the hub assembly 21 may be attached through their central axis via a threaded bolt, locking washers, and nuts. The wings 16 may be hand or machine shaped and finished. Each wing 16 may attach to the main hub assembly 21 with treaded bolts. An operator may hold onto the leading edge of each wing 15, near the hub assembly 21, as shown in FIG. 6, in order to trail behind the device, preferably with a mask, fins, and proper floatation device (where applicable by law). With the boat or watercraft 28 in motion, the operator of the device may now be pulled through the water 30 at a speed controlled by the driver of the tow vehicle. At the discretion of the operator, descent under water can be achieved by applying downward pressure by hand on each of the wings 16. Descent rate may be controlled by the pitch angle. The central hub 12 may have mechanical stops (not shown) that may be varied to control the pitch angle from about 45 degrees to about 80 degrees, depending on the skill level of the user. Ascent rate may be controlled in a similar fashion.

When sufficiently submerged, the operator can, at his/her discretion, perform controlled underwater maneuvers (left or right roll or bank turns) resurfacing at the operator's will to catch their breath by applying equal back pressure on each of the wings (or pulling up). Embodiments of the present invention may be designed for recreational use but could easily be adapted for underwater research by Scuba divers.

It should be understood, of course, that the foregoing relates to exemplary embodiments of the invention and that modifications may be made without departing from the spirit and scope of the invention as set forth in the following claims.

What is claimed is:

1. An underwater dive plane comprising:

a central rotating hub having first and second sides and a center bore;

a hole in the central rotating hub;

first and second wing holders rotatably disposed against the first and second sides of the central rotating hub;

first and second wings attached to the first and second wing holders; and a threaded bolt going through a center of the first and second wing holders, the wing holders being adapted for rotating around the threaded bolt.

2. The underwater dive plane of claim 1, further comprising a locking nut for threading onto the threaded bolt to attach the wing holders onto the central rotating hub.

3. The underwater dive plane of claim 1, further comprising a plurality of screws to removably attach the wings to the wing holders.

4. The underwater dive plane of claim 1, further comprising a rope threaded through the hole in the central hub.

5. The underwater dive plane of claim 1, wherein the central hub may rotate to a preset maximum pitch angle varying from about 45 degrees to about 80 degrees, relative to a water surface.

6. The underwater dive plane of claim 1, wherein each of the first wing and the second wing are independently rotatable about the central hub.

7. An underwater dive plane comprising:

a central rotating hub having first and second sides and a center bore;

a hole in the central rotating hub;

first and second wing holders rotatably disposed against the first and second sides of the central rotating hub;

first and second wings attached to the first and second wing holders;

a threaded bolt going through a center of the first and second wing holders, the rotating wing holders being adapted for rotating around the threaded bolt; and a locking nut for threading onto the threaded bolt to attach the wing holders onto the central rotating hub.

8. The underwater dive plane of claim 7, wherein the first and second wings are removably attached to the first and second wing holders.

9. The underwater dive plane of claim 7, wherein each of the first and the second wing are independently rotatable about the central hub.

10. An underwater dive plane comprising:

a central rotating hub having first and second sides and a center bore;

a hole in the central rotating hub;

first and second wing holders rotatably disposed against the first and second sides of the central rotating hub;

a threaded bolt going through a center of the first and second wing holders, the wing holders being adapted for rotating around the threaded bolt;

first and second wings attached to the first and second wing holders; and a rope threaded through the hole in the central hub.

11. The underwater dive plane of claim 10, further comprising a locking nut for threading onto the threaded bolt to attach the wing holders onto the central rotating hub.

12. The underwater dive plane of claim 10, further comprising a plurality of screws to removably attach the wings to the wing holders.

13. The underwater dive plane of claim 10, wherein the central hub may rotate to a preset maximum pitch angle varying from about 45 degrees to about 80 degrees, relative to a water surface.

14. The underwater dive plane of claim 10, wherein each of the first wing and the second wing are independently rotatable about the central hub.

* * * * *